US005142192A

United States Patent [19]

Takahashi et al.

[11] Patent Number: 5,142,192

[45] Date of Patent: Aug. 25, 1992

[54] THIN FILM ELECTROLUMINESCENT ELEMENT

[75] Inventors: Masaetsu Takahashi; Seiichi Oseto; Yoshiyuki Kageyama; Kenji Kameyama; Hiroshi Deguchi, all of Yokohama, Japan

[73] Assignee: Ricoh Company, Ltd., Tokyo, Japan

[21] Appl. No.: 751,567

[22] Filed: Aug. 22, 1991

Related U.S. Application Data

[63] Continuation of Ser. No. 407,586, Sep. 15, 1989, abandoned.

[30] Foreign Application Priority Data

Sep. 20, 1988 [JP] Japan ..... 63-233750
Jan. 10, 1989 [JP] Japan ..... 1-2002

[51] Int. Cl.[5] ..... H01J 1/62

[52] U.S. Cl. ..... 313/506; 313/116; 313/498

[58] Field of Search ..... 313/498, 503, 506, 509, 313/510, 512, 111, 116

[56] References Cited

U.S. PATENT DOCUMENTS

| | | | |
|---|---|---|---|
| 3,295,002 | 12/1966 | Amans | 313/503 |
| 3,299,307 | 1/1967 | Inoue | 313/503 |
| 3,728,594 | 4/1973 | Yim et al. | 313/503 X |
| 4,027,192 | 5/1977 | Hanak | 313/506 |
| 4,058,750 | 11/1977 | Schoberl | 313/510 X |
| 4,168,102 | 9/1979 | Chida et al. | 313/111 |
| 4,908,603 | 3/1990 | Yamaue et al. | 313/506 X |

FOREIGN PATENT DOCUMENTS

| | | | |
|---|---|---|---|
| 2033125 | 5/1980 | United Kingdom | 340/781 |

*Primary Examiner*—Donald J. Yusko
*Assistant Examiner*—Michael Horabik
*Attorney, Agent, or Firm*—Oblon, Spivak, McClelland, Maier & Neustadt

[57] ABSTRACT

A thin film electroluminescent element includes a luminous layer for emitting light by applying a voltage to the luminous layer through an electrode, the electrode being made of a metal; and a material for scattering the light and disposed on an end face of the luminous layer. A large picture polychromatic display apparatus includes a thin film electroluminescent element; and a material for scattering light and disposed in a luminous portion for emitting the light on an end face of the electroluminescent element, the light-scattering material forming a picture element. The display apparatus may include a thin film electroluminescent element formed by sequentially stacking a metallic electrode, an insulating layer and a luminous layer with each other on a glass substrate; and a material for scattering light and disposed on an end face of the element by scribing the element in the longitudinal direction thereof, the display apparatus being formed by combining a plurality of such elongated elements with each other, each of the elongated elements being provided with the light-scattering material. In the element, a plurality of luminous layers having different luminous wavelength characteristics are stacked with each other, and an insulating layer and a metallic electrode are disposed on both sides of the luminous layers. The light-scattering material mixes the lights emitted from the luminous layers with each other by the scattering of the lights and is disposed on the end faces of the luminous layers.

8 Claims, 4 Drawing Sheets

THIN FILM ELECTROLUMINESCENT ELEMENT

This application is a Continuation of application Ser. No. 07/407,586, filed on Sept. 15, 1989, now abandoned.

BACKGROUND OF THE INVENTION

The present invention relates to a thin film electroluminescent element (which is called a thin film EL element in the following description) and a large picture polychromatic display apparatus using this thin film EL element.

The thin film EL element utilizes a luminous phenomenon caused when a strong electric field is applied to a fluorescent material, and has been applied to a large picture flat panel display having excellent visuality.

In general, ITO(Indium Tin Oxide) is used as a material of a transparent electrode in the EL element and is a mixture of tin oxide and indium oxide. However, the heat-resisting property of the ITO is bad and it is necessary to heat a substrate to a high temperature when alkaline earth chalcogenide is used as a luminous layer in the EL element. Therefore, there is a case in which the resistance of the ITO is increased or the ITO is decomposed. To solve this problem, there is a trial using zinc oxide having a heat-resisting property better than that of the ITO. However, such a material having an excellent reliability for a long period is not obtained. The resistance of the transparent electrode is increased as the length of the electrode is increased so that this problem is especially serious in the large picture display.

In the polychromatic thin film EL element of a stacking type, it is necessary to dispose a plurality of transparent electrodes and a thermal hysteresis is repeated in every stacking operation of luminous and insulating layers. Accordingly, a high thermal stability is needed in the transparent electrodes.

The large picture display apparatus conventionally using a light-emitting diode (LED) as a picture element is practically used. However, the display apparatus using the LED as a picture element has the disadvantages that the element is relatively expensive and it is difficult to position the element, thereby increasing the manufacturing cost of the apparatus. Further, it is difficult to provide a full color since no blue luminescence is practically used. In addition, there are some problems about cost when the large picture polychromatic display apparatus is constructed by a plasma display, a liquid crystal display element, etc. as a picture element. On the other hand, there is a possibility that the thin film EL element is used as the picture element of the large picture polychromatic display apparatus. However, the element having a structure suitable for such an object is not conventionally considered.

SUMMARY OF THE INVENTION

It is therefore an object of the present invention to provide a thin film EL element using a transparent electrode and having an excellent reliability.

Another object of the present invention is to provide a polychromatic thin film EL element having an excellent reliability and constructing a large picture polychromatic display apparatus which enables a full color display accurately and finely and is manufactured cheaply, simply and accurately.

The above objects of the present invention can be achieved by a thin film electroluminescent element comprising a luminous layer for emitting light by applying a voltage to the luminous layer through an electrode, the electrode being made of a metal; and a material for scattering the light and disposed on an end face of the luminous layer.

The above objects of the present invention can be also achieved by a large picture polychromatic display apparatus comprising a thin film electroluminescent element; and a material for scattering light and disposed in a luminous portion for emitting the light on an end face of the electroluminescent element, the light-scattering material forming a picture element. The display apparatus may comprise a thin film electroluminescent element formed by sequentially stacking a metallic electrode, an insulating layer and a luminous layer with each other on a glass substrate; and a material for scattering light and disposed on an end face of the element by scribing the element in the longitudinal direction thereof, the display apparatus being formed by combining a plurality of such elongated elements with each other, each of the elongated elements being provided with the light-scattering material. In the element, a plurality of luminous layers having different luminous wavelength characteristics are stacked with each other, and an insulating layer and a metallic electrode are disposed on both sides of the respective luminous layers. The light-scattering material mixes the lights emitted from the luminous layers with each other by the scattering of the lights and is disposed on the end faces of the luminous layers.

Further objects and advantages of the present invention will be apparent from the following description of the preferred embodiments of the present invention as illustrated in the accompanying drawings.

DESCRIPTION OF THE PREFERRED EMBODIMENTS

The preferred embodiments of a thin film electroluminescent element and a large picture polychromatic display apparatus in accordance with the present invention will next be described in detail with reference to the accompanying drawings.

Figure 1:
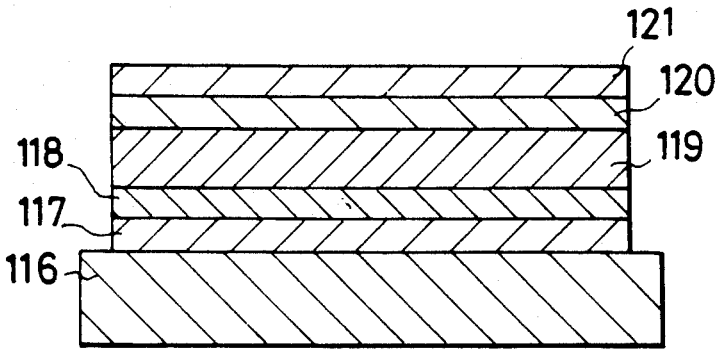
Fig. 1 PRIOR ART
FIG. 1 is a cross-sectional view of a general thin film EL element.

A typical structure of a thin film EL element is shown in FIG. 1 for example. As shown in this figure, a transparent electrode 117, an insulating layer 118, a luminous layer 119, an insulating layer 120, and a metallic electrode 121 are stacked with each other on a transparent glass substrate 116.

Figure 2:
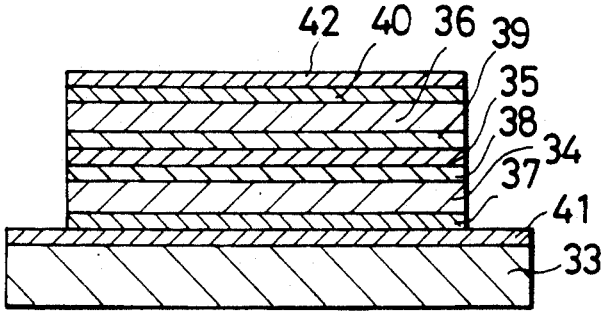
Fig. 2 PRIOR ART
FIG. 2 is a cross-sectional view of a general polychromatic thin film EL element.

As shown in FIG. 2, a general polychromatic thin film EL element of a stacking type is composed of a structure in which a transparent electrode 41, 35, a plurality of luminous layers 34, 36 having different luminous wavelength characteristics, insulating layers 37 to 40, arranged on both sides of the luminous layers, and electrodes 42 are stacked with each other. A polychromatic luminescence is caused by three-dimensionally mixing the lights from the respective luminous layers with each other.

Figure 3:
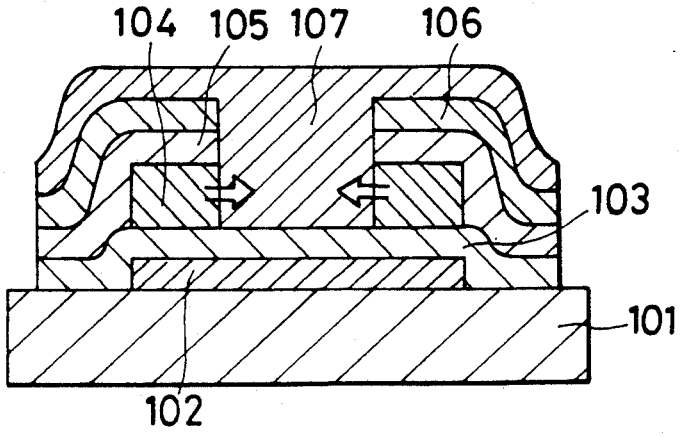
FIG. 3 is a cross-sectional view of a thin film EL element in accordance with one embodiment of the present invention.

Next, the construction of the thin film EL element in accordance with one embodiment of the present invention will be described with reference to the drawings. In FIG. 3, reference numeral 101 is a glass plate, 102 and 106 metallic electrodes, 103 and 105 insulating layers, and reference numeral 104 is a luminous layer. A light-scattering material 107 is composed of a substance for scattering light and is disposed in an element portion formed after the luminous layer 104, the insulating layer 105 and the metallic electrode 106 are partially removed by etching.

When a high voltage is applied between the metallic electrodes 102 and 106, an electroluminescent light is caused by a strong electric field within the luminous layer. This light is reflected by the metallic electrodes 102 and 106 and is emitted from only an end face of the luminous layer 104 as shown by arrows without leaking the light in the vertical direction. The light emitted to the light-scattering material 107 is irregularly reflected, but the light directed downwardly is reflected by the metallic electrode 102 as a lower face so that the light is emitted onto only the upper face of the light-scattering material. Namely, it is possible to effectively take out the light generated in the luminous layer 104 by the light-scattering material 107 perpendicularly and upwardly with respect to the substrate.

In the construction of the EL element mentioned above, the light is taken out upwardly from the substrate so that it is not necessary to make the substrate transparent. Therefore, an opaque substrate such as a ceramic substrate, etc. can be used instead of the glass substrate 101. Aluminum, silver, etc. can be used as the metallic electrodes 102 and 106. The insulating layers 103 and 105 can be made of an oxide such as $SiO_2$, $Ta_2O_5$, $Y_2O_3$, etc., a nitride such as BN, AIN, $Si_3N_4$, etc. and their compound films, a fluoride such as $CaF_2$, $MgF_2$, etc., or a ferroelectric substance of a perovskite type such as $SrTiO_3$, $PbTiO_3$, etc. The luminous layer is made of ZnS adding Mn thereto or made of an alkaline earth element chalcogenide adding thereto a rare earth element such as Ce, Eu, etc. The thin film EL element is formed by stacking the above-mentioned materials with each other. A portion of the EL element is removed therefrom by photolithography to form the light-scattering material 107 for taking out the light in the thin film EL element. Next, the light-scattering material is formed and thereby the EL element is completely formed.

This light scattering material can be made of bisphenol-based epoxy resin (for example, trade name ARALDITE manufactured by CIBA-GEIGY (Japan) Limited), etc.

The present invention will next be described in detail with reference to the following detailed embodiments.

EMBODIMENT 1

In the EL element shown in FIG. 3, aluminosilicate glass is used as the glass substrate 101. The metallic electrodes 102 and 106 are made of aluminum and the insulating layer 103 is made of AIN. The insulating layer 105 is made of a stacking film composed of AIN and $SiO_2$ and the luminous layer 104 is made of SrS adding Ce thereto.

The metallic electrode 102 on the side of the glass substrate 101 in the light taking-out portion is left to reflect the light such that the light is not emitted onto the side of the glass substrate 101. Further, the luminous layers are separated from each other every element such that the light does not leak to the adjacent elements. A circular opening portion having a diameter about 1 mm is disposed as the light taking-out portion. A white epoxy resin is formed as the light-scattering material in this circular opening portion. This epoxy resin also functions as a protecting layer for protecting the element. In accordance with the element in this embodiment, the light emitted from an end face of the luminous layer is scattered by the epoxy light-scattering material so that a bright light appears on the upper face of the substrate. In this embodiment, there is no increase in resistance of the electrode after the formation of the element caused in the element using the transparent electrode. In this embodiment, the element has no construction in which the light is emitted through the glass substrate. Accordingly, an opaque ceramic substrate may be clearly used instead of the transparent glass substrate.

EMBODIMENT 2

Figure 4:
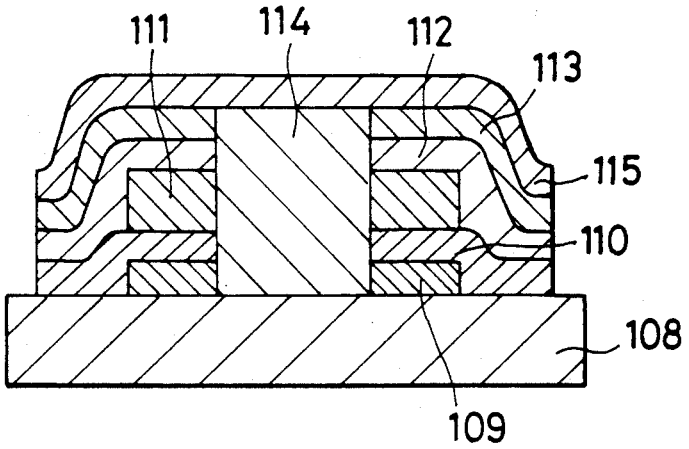
FIG. 4 is a cross-sectional view of the thin film EL element in accordance with another embodiment of the present invention.

FIG. 4 shows another embodiment of the present invention. Similar to the above-mentioned embodiment, aluminum metallic electrodes 109 and 113, an AIN insulating layer 110, a luminous layer 111 composed of SrS adding Ce thereto, and an insulating layer 112 composed of a stacking film made of AIN and $SiO_2$ are formed on a glass substrate 108. The luminous layers are separated from each other every element to prevent the light from leaking to the adjacent elements. A circular opening portion having a diameter about 1 mm is disposed as the portion for taking out the light. A white epoxy resin is formed as a light-scattering material 114. In this embodiment, to emit the light through the glass substrate 108, a protecting layer 115 composed of a black epoxy resin is disposed to prevent the light from leaking on the rear side of the substrate 108.

As mentioned above, in accordance with the present invention, no transparent electrode is used in the EL element, thereby providing a thin film EL element having an excellent reliablility for a long time in which the resistance of the electrode is not increased.

Figure 5:
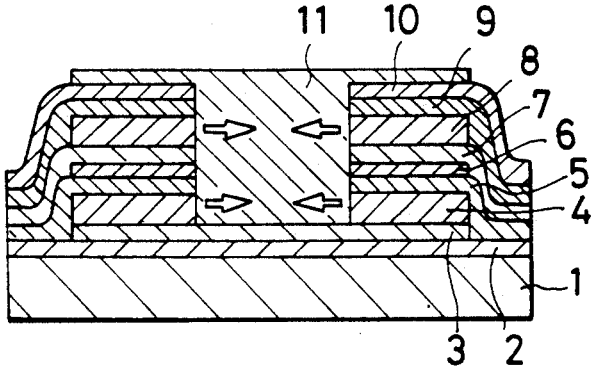
FIG. 5 is a cross-sectional view of a polychromatic thin film EL element in accordance with another embodiment of the present invention.

FIG. 5 shows the construction of the thin film EL element in accordance with another embodiment of the present invention.

In FIG. 5, similar to the above-mentioned embodiments, reference numeral 1 is a glass plate, 2, 6 and 10 metallic electrodes, 3, 5, 7 and 9 insulating layers, and reference numerals 4 and 8 are luminous layers. A light-scattering material 11 is composed of a substance for scattering light and is disposed in an element portion after the luminous layers 4 and 8, the insulating layers 5, 7, 9 and the metallic electrodes 6, 10 are partially removed by etching. When a high voltage is applied between the metallic electrodes 2 and 6 and between the metallic electrodes 6 and 10, an electroluminescent light is caused by a strong electric field within the luminous layers. This light is reflected by the metallic electrodes and is emitted from only end faces of the luminous layers 4 and 8 as shown by the arrows without leaking the light in the vertical direction. The light emitted to the light-scattering material 11 is irregularly reflected, but the light directed downwardly is reflected by the metallic electrode 2 as a lower face so that the light is emitted onto only the upper face of the light-scattering material. Namely, it is possible to mix the lights generated in the luminous layers 4 and 8 with each other by the light-scattering material 11 and effectively take out the mixed lights perpendicularly and upwardly with respect to the substrate.

In the construction of the EL element mentioned above, the lights are taken out upwardly from the substrate so that it is not necessary to make the substrate transparent. Therefore, an opaque substrate such as a ceramic substrate, etc. can be used instead of the glass substrate. Aluminum, silver, etc. can be used as the metallic electrodes 2, 6 and 10. The insulating layers 3, 5, 7 and 9 can be made of an oxide such as $SiO_2$, $Ta_2O_5$, $Y_2O_3$, etc., a nitride such as BN, AIN, $Si_3N_4$, etc. and their compound films, a fluoride such as $CaF_2$, $MgF_2$, etc., or a ferroelectric substance of a perovskite type such as $SrTiO_3$, $PbTiO_3$, etc. The luminous layers are made of ZnS adding Mn and/or Tb thereto or made of an alkaline earth element chalcogenide adding thereto a rare earth element such as Ce, Eu, etc. The thin film EL element is formed by stacking the above-mentioned materials with each other. A portion of the EL element is removed therefrom by photolithography to form the light-scattering material 11 for taking out the light in the thin film EL element. Next, the light-scattering material made of epoxy resin, etc. is formed and thereby the display apparatus is completely formed.

A large picture polychromatic display apparatus of the present invention constructed from the thin film EL element having a structure different from the above-mentioned structure will next be described with reference to FIGS. 7 to 11.

Figure 7:
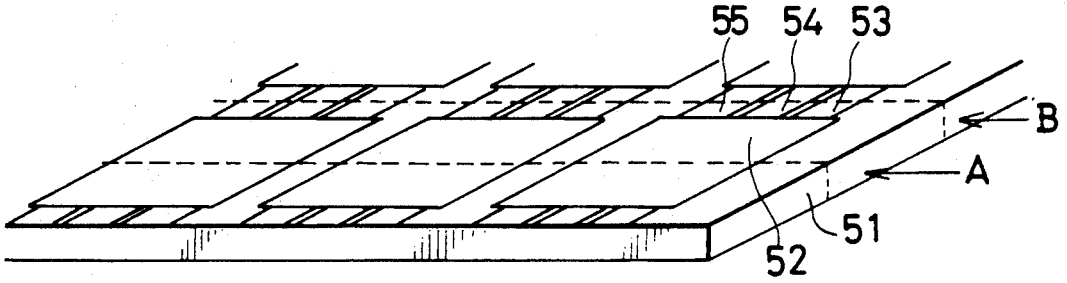
FIG. 7 is a perspective view of the polychromatic thin film EL element formed on a glass substrate.
Figure 8:
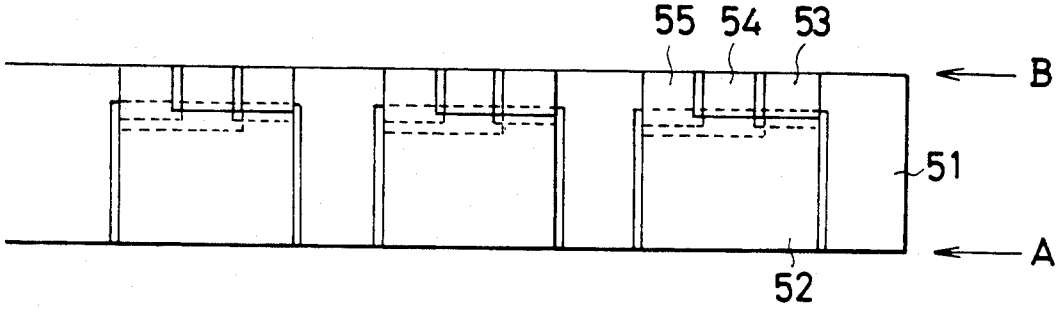
FIG. 8 is a view showing an upper face of the polychromatic thin film EL element.
Figure 9:
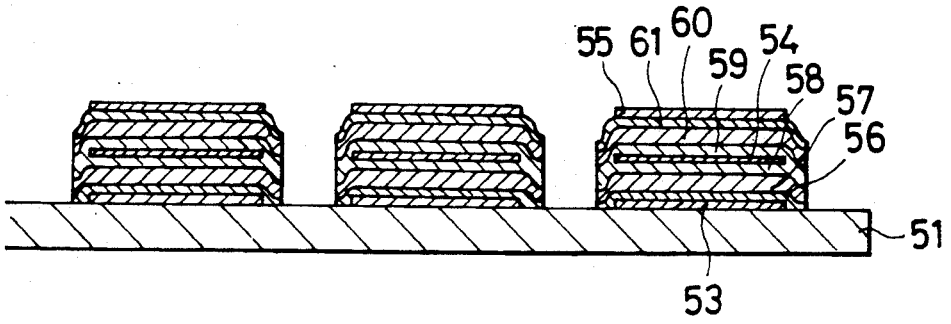
FIG. 9 is a cross-sectional view of the polychromatic thin film EL element.
Figure 10:
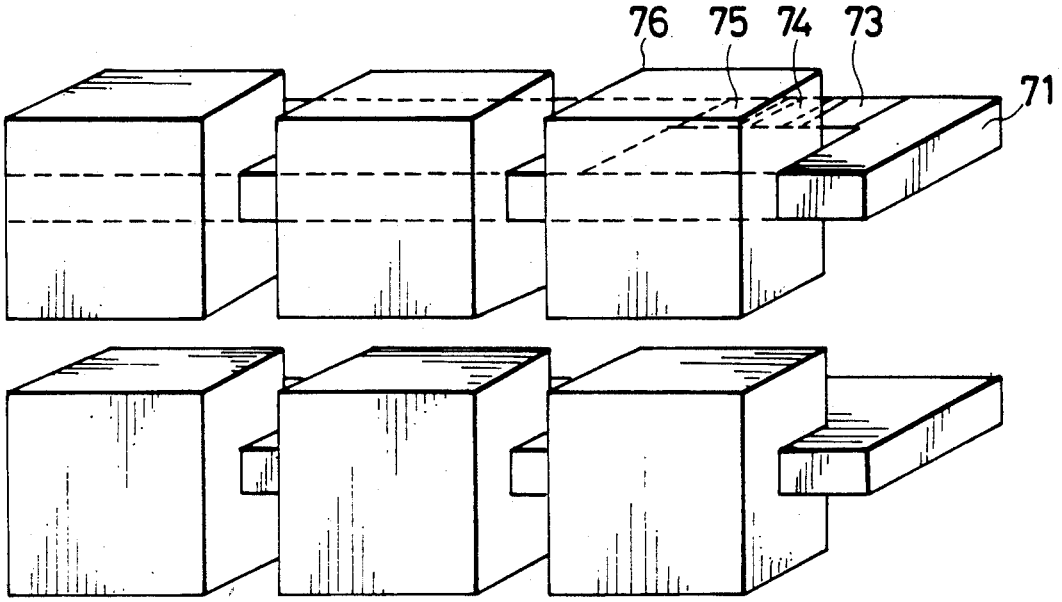
FIG. 10 is a view partially showing a light-scattering layer formed on an end face of each polychromatic thin film EL element and the polychromatic EL elements assembled as a large picture polychromatic display apparatus.

FIG. 7 shows a number of polychromatic thin film EL elements constituting picture elements of the large picture polychromatic display apparatus and formed on a glass substrate. Reference numeral 51 designates this glass substrate and reference numeral 52 designates a polychromatic thin film EL element of a stacking type in which a metallic electrode, an insulating layer and luminous layers having different luminous wavelength characteristics are sequentially stacked with each other. Reference numerals 53, 54 and 55 designate metallic electrodes. The glass substrate forming the polychromatic thin film EL element thereon is scribed in dotted-line portions shown by arrows A and B to obtain an elongated polychromatic thin film EL element of an end face luminous type. FIG. 8 shows the thin film EL element obtained by the above scribing operation and seen from above. The metallic electrode is patterned as shown in FIG. 8 to dispose a taking-out electrode. FIG. 9 is a cross-sectional view of the thin film EL element obtained by the scribing operation and seen from the end face direction shown by the arrows A. In this figure, reference numerals 56, 58, 59 and 61 designate insulating layers, 57 a first luminous layer and reference numeral 60 designates a second luminous layer. When a voltage is applied between the metallic electrodes 53 and 54 or between the metallic electrodes 54 and 55 in this thin film EL element, an intensive light is emitted from the end face of the luminous layer 57 or 60. The luminous brightness from this end face shows an intensity about 100 times that in the case of a face luminescence. Since the light is emitted from a narrow region having a width about 1 μm and the intensity thereof is very large, this light is not suitable for the application of the display apparatus as it is as a picture element. Namely, it is necessary to scatter the light to a certain extent so as to construct an element having suitable size and brightness as the picture element of the large picture display apparatus. In consideration of this object, FIG. 10 shows a state in which a light-scattering material 76 is formed in an end face portion of the EL element as the picture element. Reference numeral 71 designates a glass substrate and reference numerals 73, 74, and 75 designate metallic electrodes. Lights having different luminous wavelength characteristics are respectively emitted from the end faces of the first and second luminous layers and are mixed with each other within the light-scattering material. The mixed lights are then emitted from a surface of the light-scattering material. The light-scattering material uniforms the brightness within the picture element and also functions as a protecting material for protecting the thin film EL element. The plural arrayed thin film EL elements of the end face luminous type manufactured as mentioned above are assembled with each other to completely form a large picture polychromatic display apparatus. The positioning of the elements in assembly is relatively easily performed accurately since the plural elements are already linearly aligned with each other.

In the construction of the EL element mentioned above, the lights are taken out from the end face of the element so that it is not necessary to make the substrate transparent. Therefore, an opaque substrate such as a ceramic substrate, etc. can be used instead of the glass substrate. Aluminum is used as the metallic electrodes. The insulating layers can be made of an oxide such as $SiO_2$, $TA_2O_5$, $Y_2O_3$, etc., BN, AIN, or a ferroelectric substance of a perovskite type such as $Si_3NiO_3$, $PbTiO_3$, etc. The luminous layers are made of ZnS adding Mn and/or Tb thereto or made of an alkaline earth element chalcogenide adding thereto a rare earth element such as Ce, Eu, etc. The polychromatic thin film EL element stacking the above-mentioned materials with each other is scribed by a diamond scriber, etc., and the light-scattering material made of epoxy resin etc. is formed by molding in the end face portion of the luminous layer.

The present invention will be further explained in detail with reference to the following detailed embodiments.

EMBODIMENT 3

In the EL element shown in FIG. 5, aluminosilicate glass is used as the glass substrate 1. The metallic electrodes 2, 6 and 10 are made of aluminum and the insulating layers 3 and 7 are made of AIN. The insulating layers 5 and 9 are made of a stacking film composed of AlN and $SiO_2$ and the luminous layer 4 is made of CaS adding Eu thereto. The luminous layer 8 is made of SrS adding Ce thereto. The epoxy resin is constructed by dispersing the light-scattering material (XN1234 manufactured by CIBA-GEIGY (Japan) Limited) in ARALDITE (main material: XN1233-4A, and curing agent: XN1233-4B manufactured by the same company) used as a resin for sealing an LED.

A lift-off method is used in a lithography process since the light is reflected by the metallic electrode 2 in the light taking-out portion and it is necessary to separate the luminous layers from each other every element such that the light does not leak to the adjacent elements. Thus, a circular opening portion having a diameter about 1 mm is disposed as the light taking-out portion. Further, a white epoxy resin is formed as the scattering material in this circular opening portion. In this case, this epoxy resin also functions as a protecting material of the element. In the EL element in this embodiment, lights emitted from the end faces of the respective luminous layers are scattered by the scattering material made of epoxy resin so that the mixed lights appear on an upper face of the substrate. Further, in this embodiment, there is no increase in resistance of the electrode after the formation of the element caused in the element using the transparent electrode. This embodiment has no structure in which the lights are emitted through the glass substrate. Therefore, an opaque ceramic substrate may be clearly used instead of the transparent glass substrate.

EMBODIMENT 4

Figure 6:
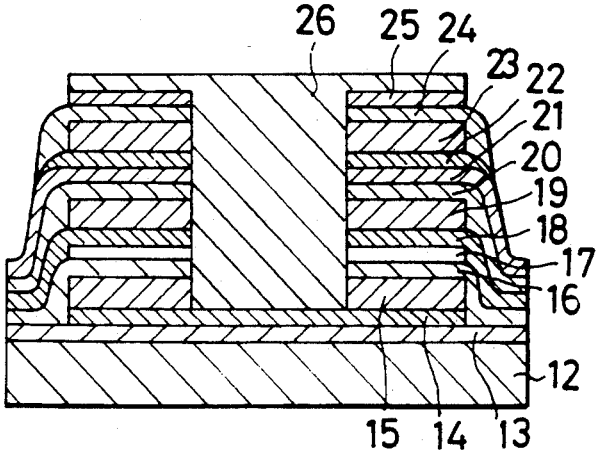
FIG. 6 is a cross-sectional view of the polychromatic thin film EL element in accordance with another embodiment of the present invention.

FIG. 6 shows the EL element in another embodiment of the present invention. Similar to the above-mentioned embodiments, aluminum metallic electrodes 13, 17, 21, 25, and AlN insulating layers 14, 18, 22 are formed on a glass substrate 12. Insulating layers 16, 20, 24 are composed of a stacking film made of AlN and $SiO_2$ and are formed on the glass substrate 12. A luminous layer 14 is made of CaS adding Eu thereto and a luminous layer 19 is made of ZnS adding Tb thereto. Further, a luminous layer 23 is made of SrS adding Ce thereto. These luminous layers are also formed on the glass substrate 12. The luminous layers are separated from each other every element to prevent the light from leaking to the adjacent elements. A circular opening portion having a diameter about 1 mm is disposed as the light taking-out portion. Further, the same white epoxy resin as that used in the Embodiment 3 is used to form a scattering material 26.

EMBODIMENT 5

In the EL element shown in FIG. 9, aluminosilicate glass is used as the glass substrate 51. The metallic electrodes 53, 54 and 55 are made of aluminum. The insulating layers 56 and 59 are made of AlN. The insulating layers 58 and 61 are composed of a stacking film made of AlN and $SiO_2$. The luminous layer 57 is made of CaS adding Eu thereto. The luminous layer 60 is made of SrS adding Ce thereto. The epoxy resin is constructed by that used in the Embodiment 3. To prevent crosstalk between the picture elements, the thin film EL elements are separated from each other every picture element by using the photolithography process.

In this embodiment, the EL elements are formed on only one or front side of the glass substrate, but it is possible to form the EL elements on the rear side of the substrate similar to the front side thereof. By such a construction, it is possible to double the luminous brightness of the picture element.

EMBODIMENT 6

Figure 11:
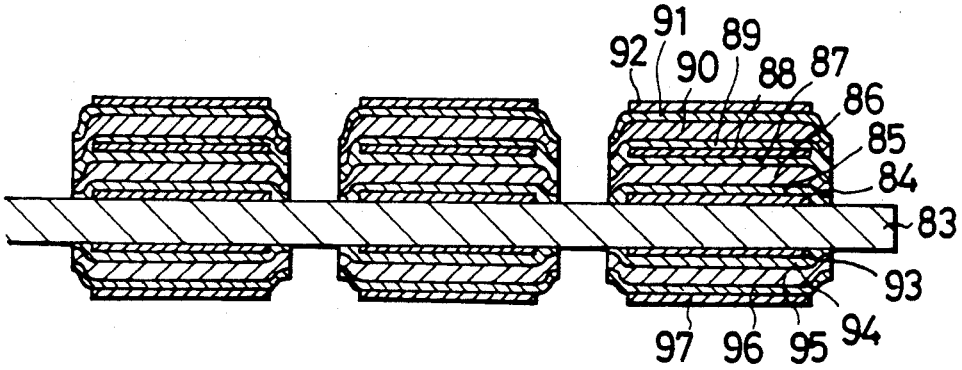
FIG. 11 is a cross-sectional view of the polychromatic thin film EL element used in an Embodiment 4.

FIG. 11 shows the EL element in another embodiment of the present invention. Similar to the above-mentioned embodiments, aluminum metallic electrodes 84, 88, 92, 93, 97, and AlN insulating layers 85, 89, 94 are formed on the front and rear sides of a glass substrate 83. Insulating layers 87, 91, 96 are composed of a stacking film made of AlN and $SiO_2$ and are formed on the front and rear sides of the glass substrate 83. A luminous layer 86 is made of CaS adding Eu thereto and a luminous layer 90 is made of ZnS adding Tb thereto. A luminous layer 95 is made of SrS adding Ce thereto. These luminous layers are also formed on the front and rear sides of the glass substrate 83. The elements are separated from each other every picture element to prevent the crosstalk therebetween. Similar to the Embodiment 5, the scribing operation is performed and the epoxy resin is formed on the end faces of the luminous layers as the scattering material.

As mentioned above, in accordance with the present invention, no transparent electrode is used in the EL element, thereby providing a polychromatic thin film EL element having an excellent reliability for a long time in which the resistance of the electrode is not increased.

Further, by using this EL element, the present invention can provide a large picture polychromatic display apparatus which is cheaply manufactured simply and enables a full color display accurately and finely.

Many widely different embodiments of the present invention may be constructed without departing from the spirit and scope of the present invention. It should be understood that the present invention is not limited to the specific embodiments described in the specification, except as defined in the appended claims.

What is claimed is:

1. A thin film electroluminescent element comprising:

a luminous layer having two sides opposite to each other and an inner end face defining a central bore, said luminous layer adapted to emit light by applying a voltage between said two sides;

first electrode means disposed on said luminous layer at one side of said two sides for applying said voltage to said luminous layer, said first electrode means being adapted to reflect the light in the luminous layer to guide the light toward said inner end face;

second electrode means disposed on said luminous layer at the other side of said two sides for applying said voltage to said luminous layer, said second electrode means being adapted to reflect the light in the luminous layer to guide the light toward said inner end face, at least one of said first electrode means and second electrode means having a bore consistent with said bore of said luminous layer; and central scattering means filled in said central bore of said luminous layer for scattering the light from the inner end face, so that the light from said inner end face is taken out perpendicularly with respect to said luminous layer.

2. A thin film electroluminescent element according to claim 1, wherein each of said first electrode means and said second electrode means comprises an insulating layer in contact with said luminous layer at one side thereof and a metal electrode disposed on said insulating layer at the other side of said insulating layer.

3. A thin film electroluminescent element according to claim 2, wherein said metal electrode of said first electrode is formed on a substrate.

4. A thin film electroluminescent element according to claim 3, wherein said second electrode means has said bore, and said scattering means is formed on said first electrode means.

5. A thin film electroluminescent element according to claim 4, wherein another luminous layer is disposed on said second electrode means through an insulating film, a third electrode means is disposed on said another luminous layer, and said scattering means extends to an end face of said another luminous layer.

6. A thin film electroluminescent element according to claim 5. wherein said luminous layer and said another luminous layer have luminous wavelength characteristics different from each other.

7. A thin film electroluminescent element according to claim 3, wherein said luminous layer has an outer end face, and said second electrode means surrounds said outer end face.

8. A thin film electroluminescent element according to claim 3, wherein each of said first electrode means and said second electrode means has said bore, said substrate is made of glass, and an upper face of said second electrode means and an upper face of said scattering means is covered with a black protecting layer.

* * * * *